US006241901B1

(12) United States Patent
Leung

(10) Patent No.: US 6,241,901 B1
(45) Date of Patent: Jun. 5, 2001

(54) CENTRIFUGE WITH THICKENED-FEED ACCELERATOR BETWEEN INNER AND OUTER BOWL SECTIONS

(75) Inventor: Woon-Fong Leung, Sherborn, MA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/324,209

(22) Filed: Jun. 2, 1999

Related U.S. Application Data

(60) Provisional application No. 60/087,824, filed on Jun. 3, 1998.

(51) Int. Cl.[7] ..... B04B 1/00; B04B 1/20; B04B 3/04

(52) U.S. Cl. ..... 210/781; 210/787; 210/360.1; 210/374; 210/380.1; 494/37; 494/52; 494/53; 494/54; 494/56

(58) Field of Search ..... 494/37, 52, 53, 494/54, 56; 210/360.1, 374, 380.1, 781, 787

(56) References Cited

U.S. PATENT DOCUMENTS

| | | |
|---|---|---|
| 3,245,613 | 4/1966 | Jonakin . |
| 4,617,010 | 10/1986 | Epper et al. . |
| 5,551,943 | 9/1996 | Leung et al. . |

FOREIGN PATENT DOCUMENTS

| | | |
|---|---|---|
| 976 357 | 6/1963 | (DE) . |
| 3324973 | 1/1985 | (DE) . |
| 36 22 655 A1 | 1/1988 | (DE) . |
| 2 064 997 | 6/1981 | (GB) . |

OTHER PUBLICATIONS

Moderne Industriezentrifugen. Sokolow, W.J. Veb Verlag Technik, Berlin 1971, pp. 354–377.

*Primary Examiner*—David A. Reifsnyder
(74) *Attorney, Agent, or Firm*—R. Neil Sudol; Henry D. Coleman

(57) ABSTRACT

A centrifuge has a hub and a first bowl section extending about the hub. The first bowl section has a given diameter at a downstream end of a heavy phase transport path along the first bowl section. The centrifuge further comprises a second bowl section having an input end at the downstream end of the first bowl section. The input end of the second bowl section has a diameter which is greater than the diameter of the first bowl section at the downstream end thereof. The input end of the second bowl section is disposed radially outwardly of the first bowl section at the downstream end thereof. A feed accelerator is disposed at the downstream end of the first bowl section, and more particularly between the downstream end of the first bowl section and the input end of the section bowl section, for tangentially accelerating a thickened feed or cake between the downstream end of the first conical bowl section and the input end of the second bowl section. The feed accelerator serves to accelerate, in the direction of rotation (as opposed to radially accelerating), a thickened feed of nominally 40–60% solids moving from the downstream end of the first conical bowl section to the upstream end of the second conical bowl section.

26 Claims, 13 Drawing Sheets

CENTRIFUGE WITH THICKENED-FEED ACCELERATOR BETWEEN INNER AND OUTER BOWL SECTIONS

CROSS-REFERENCE TO A RELATED APPLICATION

This application relies for priority purposes on U.S. provisional application No. 60/087,824 filed Jun. 3, 1998.

BACKGROUND OF THE INVENTION

This invention relates to a centrifuge and to an associated method of operating a centrifuge. The apparatus and method of the invention are particularly, but not exclusively, applicable in cantilever screen-scroll type centrifuges.

Conical screen-scroll centrifuges have been used to dewater thickened slurries from nominally 40–60% feed solids to nominally 80–95+% solids (or 20–5% cake moisture). As illustrated in Fig. 1A, such centrifuges comprise a scroll conveyor 10 surrounded by a screen basket 12 and disposed therewith in a housing 14. Scroll conveyor 10 and screen basket 12 are cantilevered from a support 16 at one end. At that same end, conveyor 10 and screen basket 12 are operatively connected to a single input, dual output planetary gear box or a cyclo gear box 18 which is driven by a motor 20. A feed pipe 22 extends into an open, free end of scroll conveyor 10 for delivering a thickened feed slurry thereto. The feed slurry exits an opening (not shown) in a hub 24 of conveyor 10 and is deposited onto screen basket 12. Solids 26 in the slurry are conveyed along an inner surface of screen basket 12 to a conical discharge 28 by a helical blade 30 of conveyor 12, while filtrate is discharged at 32 through screen basket 12.

A simple cross-sectional schematic of the screen-scroll centrifuge of FIG. 1A is shown in FIG. 1B. Feed slurry introduced via feed pipe 22 into a feed cone 34 of conveyor 10 is accelerated in the feed cone (arrows 36) so that when the slurry is laid onto a small diameter end 38 of screen basket 12, the slurry has acquired the proper G-force to effect filtration of the bulk liquid followed by dewatering (arrows 32) so that the remaining liquid trapped in the cake pores can be further released with time. The dewatering process is facilitated by continuously thinner cake and an increasing higher centrifugal force as the cake moves toward discharge at a larger screen diameter 42. Washing can be applied to remove the impurities in food, chemical, and mineral applications, wash liquid being introduced at small diameter 38 of conical screen basket 12 shortly after the feed zone. The washed cake is ultimately dewatered at the larger screen diameter 42. The screen drain filtrate (arrows 32) and the cake (arrow 44) are collected respectively in separate hoppers (not shown) for downstream processing.

One key benefit of the cantilever screen scroll design as illustrated in FIGS. 1A and 1B, is that both scroll conveyor 10 and screen basket 12 are opened at the front end of the machine. This allows the operator easy access to the rotating assembly for regular maintenance such as replacement of worn components (e.g. screen, worn and broken tiles, scroll, nuts and bolts), and removal of foreign objects trapped in the process streams, as well as regular visual inspection of the process during operation to assure satisfactory operation. Because the screen scroll centrifuge is a cantilever design, another advantage is that only a set of supporting bearings located at one end of the machine is required instead of two bearings associated with a horizontal end-to-end support. This minimizes significantly the overall cost of the machine. However, there is a disadvantage in that the overhung moment from the pivot or support may limit the cantilever mass as well as the distance of cantilever mass from the pivoted bearing or support. This may also result in a rotational speed limitation owing to natural frequency considerations. Another limitation of the screen-scroll-type centrifuge is that the feed has to be pre-thickened to nominally 40–60% before introduction to the screen to remove a majority of the bulk liquid. This thickening can be achieved, for example, with hydrocyclones, thickening tanks or thickening screens upstream of the dewatering screen scroll.

In a different approach, both thickening and dewatering are combined in a single unit using a screen bowl centrifuge as shown in FIG. 2. A solid-bowl configuration comprises a cylindrical bowl 46 followed by a conical beach 48 used for separation and thickening of the separated solids to form a cake. A cylindrical screen 50 downstream of the conical beach is used to further dewater the cake to lower the moisture content thereof. Consequently, dilute feed with solids content by weight of 5–50% can be used. This is advantageous over the screen scroll where only thickened feed of nominally 40+% is permissible.

The prior art centrifuge of FIG. 2 also includes a worm-type conveyor 52 for scrolling cakes solids along inner surfaces of bowl 46, beach 48, and screen 50. Effluents are discharged from a clarifier pool 54 into a centrate discharge chamber or hopper 56 of a centrifuge casing 58. Filtrate is discharged through screen 50 into a filtrate drainage chamber or hopper 60 of casing 58, while cake 62 is discharged into a solids discharge chamber or hopper 64. A feed slurry is fed into a hub 66 of conveyor 52 via a feed pipe 68. Conveyor 52 and bowl 46 are rotatably supported at opposite ends on bearings 70 and 72 and are differentially rotated via a gear unit 74.

In another variation of the screen-bowl-type centrifuge, shown is FIG. 3, a cylindrical screen section 76 is provided at a larger diameter than the diameters of a cylindrical solid bowl section 78 and a bowl section 80. A first helical conveyor blade 82 conveys cake solids along inner surfaces of bowl section 78 and bowl section 80, while a second helical conveyor blade 84 conveys cake solids along an inner surface of screen section 76. Conveyor blades 82 and 84 are rigid with a conveyor hub 86 and accordingly rotate at the same angular velocity which is slightly different from an angular velocity of screen section 76, bowl section 78 and bowl section 80.

An advantage of the design of FIG. 3 is that cake dewatering on screen section 76 is carried out at a higher G-force. A disadvantage is that as the feed as laid abruptly onto screen 76, the feed is underaccelerated, i.e., the tangential speed of the feed is much less than that of screen 76 at a solid-body rotation. This difference in tangential speed results in slippage of the feed on the screen surface as the feed is being accelerated by the screen surface, thereby causing high wear on screen 76 especially for abrasive feed materials. Furthermore, it can be shown that the undesirable radial velocity of the feed stream increases at the expense of a lower tangential speed (conservation of angular momentum). This in turn results in an increased solids penetration through screen 76, with a lower solids recovery or capture. The feed particle size can be further reduced through slippage of feed on the screen with the consequence of particle attrition which results in more loss of these fine solids through the screen. In all cases of this variation of the screen-bowl-type centrifuge, the screen bowl is horizontally arranged and supported by two bearings 88 (only one shown) at the two ends. The cost of this design is somewhat greater than the cantilever screen scroll design (FIGS. 1A and 1B) and the operator cannot access the rotating assembly as readily as in a cantilever screen scroll design.

An improvement in that direction is a cantilever screen bowl design as shown in FIG. 4. The unit includes a cylindrical bowl 90 and a conveyor 92 both rotatably cantilevered from a support located at the large diameter side of the machine. Because of this arrangement, in order to reduce the overhung bending moment, the length of the solid-bowl section 90 as well as the length of a cylindrical screen section 94 must be trimmed. The rotational speed of the machine may also limited owing to natural frequency considerations. These factors render the overhung shorter screen bowl design less effective with major disadvantageous results of lower throughput, wetter cake and dirtier effluent as compared to a regular screen bowl supported by two end-to-end bearings with the same diameter.

SUMMARY OF THE INVENTION

A centrifuge in accordance with the present invention comprises a hub and a first bowl section extending about the hub. The first bowl section has a given diameter at a downstream end of a heavy phase transport path along the first bowl section. The centrifuge further comprises a second bowl section having an input end at the downstream end of the first bowl section. The input end of the second bowl section has a diameter which is greater than the diameter of the first bowl section at the downstream end thereof. The input end of the second bowl section is disposed radially outwardly of the first bowl section at the downstream end thereof. A feed accelerator is disposed at the downstream end of the first bowl section, and more particularly between the downstream end of the first bowl section and the input end of the section bowl section, for tangentially accelerating a thickened feed or cake between the downstream end of the first conical bowl section and the input end of the second bowl section. The feed accelerator serves to accelerate, in the direction of rotation (as opposed to radially accelerating), a thickened feed or cake of nominally 40–60% solids moving from the downstream end of the first conical bowl section to the upstream end of the second conical bowl section.

It is contemplated that the hub is provided with a first conveyor blade for conveying heavy phase material along the first bowl section towards the downstream end thereof, while the first bowl section is provided along an outer surface with a second conveyor blade for conveying heavy phase material along an inner surface of the second bowl section from the input end thereof towards a cake discharge port.

The second bowl section optionally includes a screen bowl portion which has a conical portion. Where the centrifuge is of the cantilevered type, the conveyor hub, the first bowl section and the second bowl section are all cantilevered from a machine support.

Generally, the first bowl section is provided at its downstream end with a passageway through which the thickened feed or cake passes prior to deposition thereof on an inner surface of the second bowl section. The feed accelerator particularly includes a vane extending substantially radially outwardly from the passageway towards the inner surface of the second bowl section. The vane is optionally provided with an outer end which is curved forward in a direction of rotation for providing an additional tangential velocity component to the thickened feed or cake and for reducing a radial velocity component of the thickened feed or cake.

In a particular centrifuge utilizing the feed accelerator of the present invention, the second bowl section has a conically shaped upstream portion and a cylindrically shaped downstream portion. The conically shaped upstream portion may take the form of a conical basket section, with the cylindrically shaped downstream portion being a screen bowl.

In accordance with another feature of the present invention, the feed accelerator includes a smoothening element in part for spreading the thickened feed or cake out along a greater area of the second bowl section and in part for reducing any concentrated stream of thickened feed or cake impinging on the second bowl section.

A feed accelerator may also be disposed in the hub for tangentially accelerating a relatively dilute feed of 5–30% solids prior to delivering the feed from the hub to a slurry pool in the solid bowl, thereby providing the dilute feed with a rotation speed at least approximately equal to that of the slurry pool in the solid bowl. This feed accelerator eliminates slippage and turbulence of feed in the pool resulting in instantaneous G-field for separation of suspended solids in the pool. The other feed accelerator, at the downstream end of the first conical bowl section, eliminates slippage of thickened feed or cake on the screen/basket at a larger diameter, thereby reducing wear, particle attrition from slippage on the screen, and loss of fine solids. The instantaneous G-field allows best use of the screen area for bulk filtration. As a consequence, higher throughput with better quality product (drier cake, better solids recovery) is expected from both feed accelerators.

The conveyor may include a plurality of generally axial vanes extending from the hub along a substantial portion of the first bowl section. In that case, the conveyor additionally has a conveyor blade attached to radially outer edges of the vanes so that the blade extends only part of a distance from an inner surface of the solid bowl to the hub.

A method for separating a solid phase from a liquid phase of a slurry comprises, in accordance with the present invention, feeding a slurry from a conveyor hub outwardly to a clarifier pool in a bowl of a centrifuge, scrolling thickened feed or cake solids from the clarifier pool along a first bowl section of the centrifuge to a passageway at a downstream end of the first bowl section, and tangentially accelerating a thickened feed or cake upon an exiting thereof from the first bowl section through the passageway and prior to a deposition of the thickened feed or cake on a second bowl section of the centrifuge. At the passageway the second bowl section has a greater diameter than the first bowl section. The method further comprises scrolling, along the second bowl section to a cake discharge, the thickened feed or cake deposited on the second bowl section.

The tangential accelerating of the cake solids preferentially includes engaging the cake solids with a vane extending substantially radially outwardly from the passageway towards an inner surface of the second bowl section. The vane may be provided with an outer end which is curved forward in a direction of rotation, in which case the method further includes providing an additional tangential velocity component to the thickened feed or cake and reducing a radial velocity component thereof.

In accordance with another feature of the present invention, the method also includes spreading the thickened feed or cake out along an area of the second bowl section and, concomitantly, reducing any concentrated stream of thickened feed or cake impinging on the section bowl section. The spreading of the thickened feed or cake may be implemented by engaging the same with a smoothening element.

In accordance with another feature of the present invention, the method further comprises tangentially accelerating a feed slurry from a centrifuge hub prior to delivering the feed slurry to the clarifier pool in the first bowl section.

A centrifuge with a thickened-feed accelerator in accordance with the present invention may be a cantilever type centrifuge. The feed accelerator between an inner bowl section and an outer bowl section contributes to an improvement in cake throughput and moisture content over a conventional cantilever centrifuge. More specifically, the present invention is directed to providing a cantilever screen bowl centrifuge with a relatively high throughput and a relatively low cake moisture content.

A cantilevered type centrifuge which advantageously incorporates the present invention comprises a support, a conveyor cantilevered from the support, and a solid bowl also cantilevered from the support. The conveyor includes a conveyor hub cantilevered from the support, the solid bowl extending about the hub. The solid bowl includes an integral first conical bowl section which tapers radially inwardly towards an axis of the conveyor and the bowl and which has a small diameter end. The centrifuge further comprises a second conical bowl section cantilevered at least indirectly from the support, the second conical bowl section having an input end at the small diameter end of the first conical bowl section. The second conical bowl section has an increasing diameter away from its input end. The first conical bowl section and the second conical bowl section together define a heavy phase transport path having a first portion of decreasing diameter extending along the first conical bowl section towards the small diameter end thereof and a subsequent second portion of increasing diameter extending along the second conical bowl section away from the input end of the second conical bowl section It is contemplated that the second conical bowl section is a screen or conical basket section. In that event, the centrifuge is a conical screen bowl centrifuge with a conical solid beach section and a conical screen or basket of increasing diameter.

In the design of the present invention, the conical basket effects thin cake dewatering inasmuch as the cake is spread out at a larger screen circumference toward discharge. This benefit is enhanced by a higher G-force for dewatering as the cake is conveyed to a larger diameter. The conical screen with a larger surface area compensates, in part, the short cylindrical screen as shown in the cantilever design of FIG. 4.

A cantilever centrifuge embodying or incorporating the present invention is assembled in three stages or steps. The first-half of a cylindrical hub is mounted first, followed by the solid-bowl section and the conical basket. Finally, the second-half of the scroll is installed to fit the conical basket. In all cases, the clearance between the blade tip and the conical bowl wall can be reduced to the desirable tolerance by axial alignment of the components.

In a preferred cantilevered centrifuge incorporating the present invention, the conical basket section is attached to the conveyor, and more particularly to a free or downstream end of the conveyor, for rotating at a common angular velocity therewith. In addition, the conical basket section extends in an axial direction away from its input end and towards the machine support. Concomitantly, the conical basket section surrounds at least a portion of the solid bowl and particularly the conical bowl section thereof.

This preferred embodiment of cantilevered-type centrifuge combines the full benefit of the solid bowl and the conical screen scroll. Because the conical screen turns back toward the support end of the machine, the overhung moment is reduced. The screen bowl section can be made longer than in cantilever centrifuges where the screen extends away from the machine support.

In this embodiment, the outer surface of the solid-bowl is provided with a set of conveyor blades turned in the same sense as the set of conveyor blades inside the solid bowl. The solid bowl and the blades welded along its outer surface are rotated at a speed different from the rotation speed of the conveyor hub and the basket to thereby effect a continuous discharge and control of retention time of the solids in the solid bowl as well as in the basket.

In accordance with a further feature of the present invention, the second conical bowl section is provided at a free or downstream end with a cylindrical screen section.

Pursuant to yet another feature of the present invention, the conveyor has a hub and plurality of generally axial vanes extending from the hub along a substantial portion of the solid bowl (clarifier) section, while the conveyor has a conveyor blade attached to radially outer edges of the vanes so that the blade extends only part of a distance from an inner surface of the solid bowl to the hub. Thus, the conveyor blades are made of ribbon blade segments supported by the axial vanes. This structure of the conveyor improves rigidity while reducing the overhung mass. The axial vanes when submerged in the liquid pool facilitate axial flow of the effluent liquid, which reduces entrainment of the sediment in the bowl, the sediment being conveyed along the helical channels formed by adjacent conveyor blades.

Alternatively, conventional solid blades can also be used with the blades attached to the conveyor hub.

In accordance with another embodiment of the present invention, the conical basket section is attached at an upstream end to the free or downstream end of the first conical bowl section and extends in an axial direction away from the first conical bowl section, the solid bowl, and the support.

A cantilever centrifuge with a screen bowl section overlapping a solid beach section and a solid bowl clarifier section provides a heavy-duty inexpensive design with key benefits being its compact size and its easy accessibility. For the same footprint, this overlapping-type design has more screen area and a solid bowl clarifier section as compared to existing designs.

A cantilever centrifuge with a screen bowl section overlapping a solid beach section and a solid bowl clarifier section accepts dilute feed stream and obviates the prethickening equipment which is normally used for this application. This design allows higher solids throughput, purer and drier cake, and superior recovery. It is a combination of a solid-bowl and a screen-scroll/conical- horizontal screen, all in one compact design.

DESCRIPTION OF THE PREFERRED EMBODIMENTS

Figure 5:
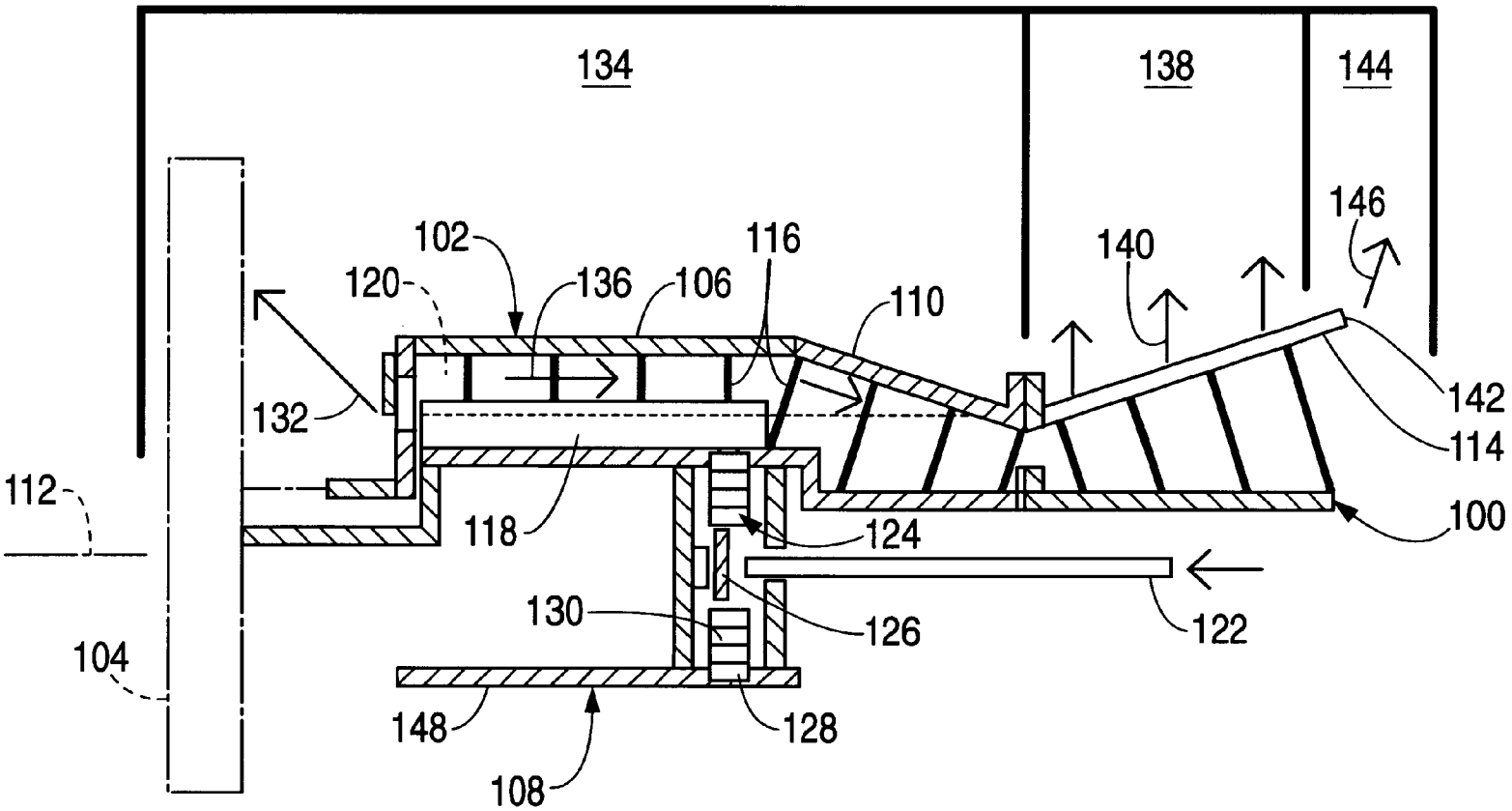
FIG. 5 is a partial longitudinal cross-sectional view of a cantilever conical screen bowl centrifuge.

As illustrated in FIG. 5, a cantilever conical screen bowl centrifuge comprises a scroll- or worm-type conveyor 100 and a bowl 102 both rotatably cantilevered from a machine support 104. Bowl 102 includes a substantially cylindrical solid bowl section 106 which extends about a hub 108 of conveyor 100. Bowl 102 further includes a solid first conical bowl section 110 connected in cantilever fashion from a free or downstream end of solid bowl section 106 disposed opposite the machine support 104. Conical bowl section 110 functions as a beach and tapers inwardly towards an axis 112 of conveyor 100 and bowl 102, in a downstream direction away from solid bowl section 106 and machine support 104. A second conical bowl section 114 in the form of a conical screen or basket is connected at an upstream end to a free or downstream end of solid conical bowl section 110 opposite the solid bowl section. Conical basket 114 tapers outwardly from rotation axis 112 in a direction away from the free or downstream end of conical bowl section 110.

Conveyor 100 includes multiple helical blades 116 which, in the region of solid bowl section 106, are attached to radially outer edges of a plurality of axially extending vanes 118 rigid with conveyor hub 108. Conveyor blades 116 extend only part of a distance an inner surface of solid bowl section 106 to hub 108 and are made of ribbon blade segments supported by vanes 118. This structure of conveyor 100 improves rigidity while reducing the overhung mass. Vanes 118, when submerged in a liquid clarifier pool 120, facilitate an axial flow of the effluent liquid, which reduces entrainment of the sediment in the bowl, the sediment being conveyed along the helical channels formed by adjacent conveyor blades.

A feed pipe 122 extends into hub 108 for delivering thereto a relatively dilute feed composition including 5–50 % solids. Conveyor 100 is provided with a feed accelerator 124 mounted to hub 108 for providing the incoming feed composition with a tangential velocity substantially equal to the tangential velocity of the slurry at the radially inner surface of clarifier pool 120. Accelerator 124 includes a distributor 126 which receives the incoming feed composition and directs it to a plurality of feed openings or passageways 128 in hub 108. Distributor 126 may be formed with a plurality of axially extending vanes (not shown) for imparting some measure of tangential velocity to the feed composition prior to the exit of the feed composition through feed openings 128. Accelerator 124 further includes a plurality of anti-Coriolis baffles 130 extending inwardly into hub 108 at respective feed openings 128. In addition, accelerator 124 may include a plurality of vanes (not shown) extending substantially radially outwardly from respective feed openings 128 and, optionally, one or more smoothening elements (not shown) located between feed openings 128 and clarifier pool 120 for spreading out the feed stream from each opening 128. All of these features are described in detail in U.S. Pat. Nos. 5,551,943, 5,632,714, and 5,520,605, the disclosures of which are hereby incorporated by reference.

During the operation of the cantilever conical screen bowl centrifuge of FIG. 5, effluent leaves the clarifier pool 120 at 132 and enters a casing compartment or chamber 134, while cake solids are conveyed along inner surfaces of solid bowl section 106, conical beach section 110 and conical screen section or basket 114 by blades 116 of conveyor 100, as indicated by arrows 136. Along conical screen section or basket 114, filtrate exits bowl 102 into a casing compartment or chamber 138, as indicated by arrows 140. Finally, cake is discharged at a free rim or lip 142 of conical screen section or basket 114 into a casing compartment or chamber 144, as indicated by an arrow 146.

The cantilever conical screen bowl centrifuge of FIG. 5 is assembled in three stages or steps. A first-half 148 of hub 108 together with connected conveyor blades (not separately designated) is mounted first, followed by solid-bowl section 106 with conical beach section 110, and subsequently by conical basket 114. Finally, a second-half of the scroll or conveyor blades (not separately designated) is installed to fit conical basket 114.

Figure 11:
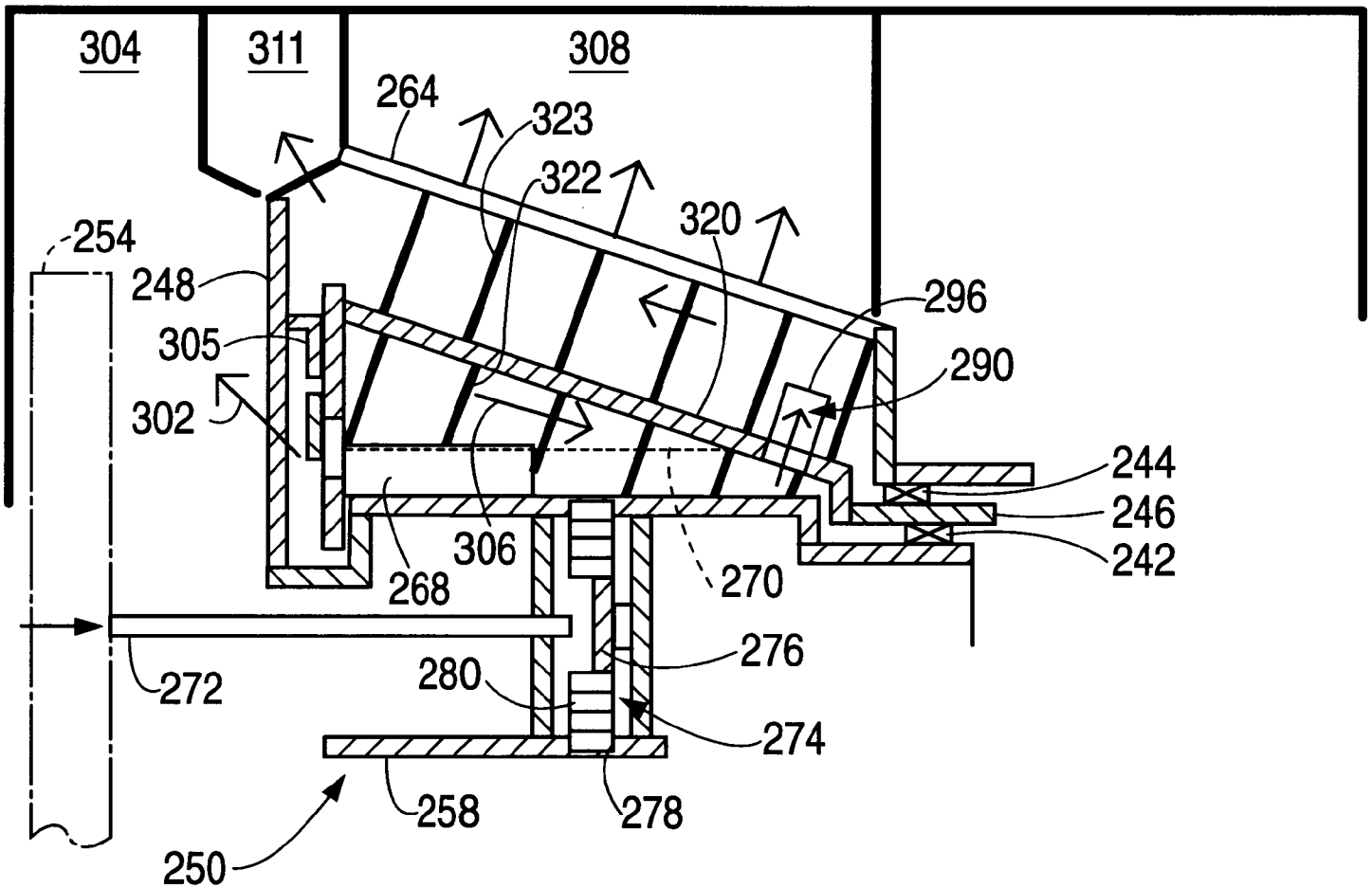
FIG. 11 is a partial longitudinal cross-sectional view of yet another cantilever conical screen bowl centrifuge in accordance with the present invention.

It is to be noted that cylindrical solid-bowl section 106 may be omitted, with conical solid-bowl section 110 being directly mounted to machine support 104. An analogous double-conical bowl in a folded back design is shown in FIG. 11, discussed below.

Figure 6:
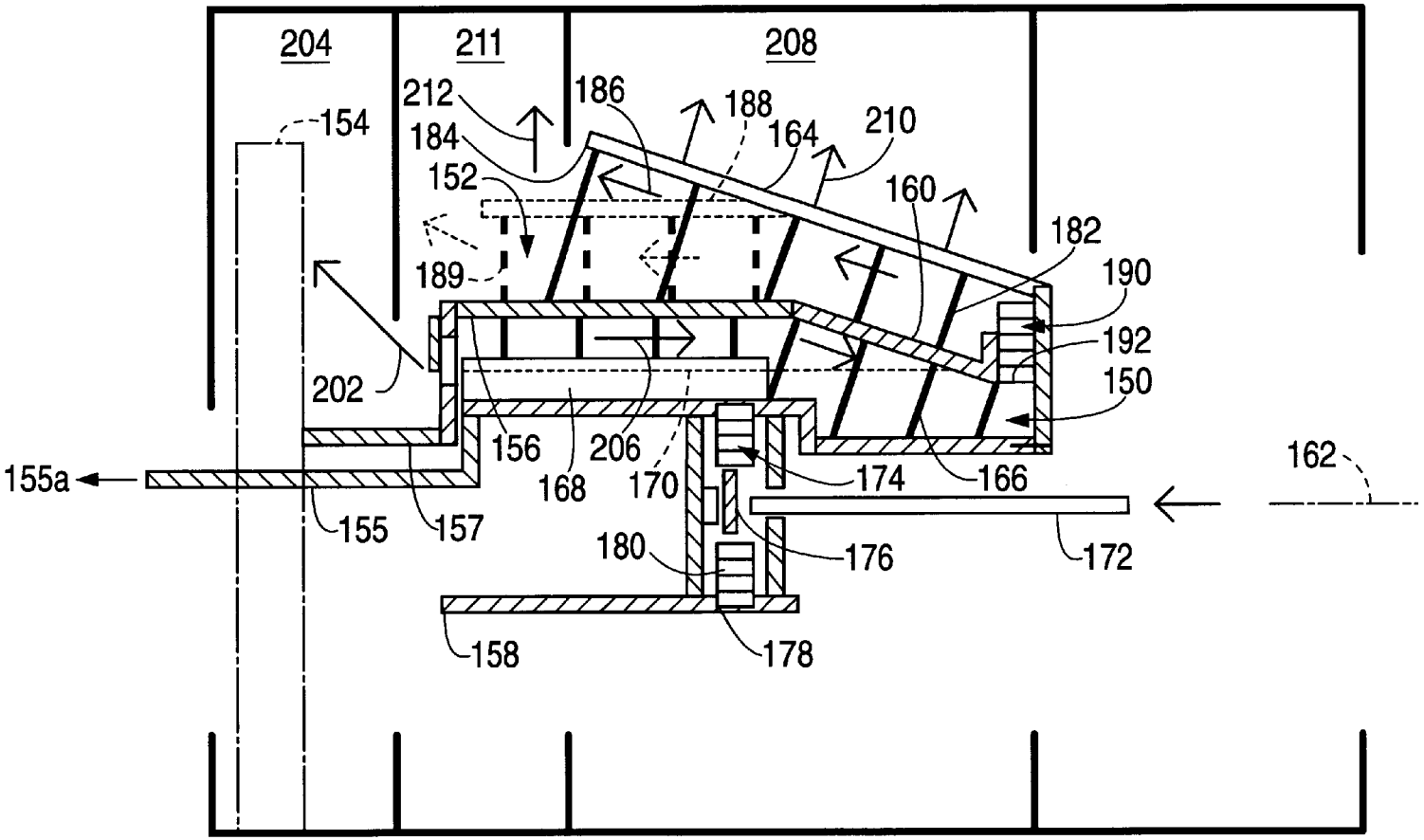
FIG. 6 is a partial longitudinal cross-sectional view of another cantilever conical screen bowl centrifuge in accordance with the present invention.

As illustrated in FIG. 6, another cantilever conical screen bowl centrifuge comprises a scroll- or worm-type conveyor 150 and a solid bowl 152 both rotatably cantilevered from a machine support 154 which includes a gear box, bearings, motor and sheave (none illustrated). Bowl 152 includes a substantially cylindrical solid bowl section 156 which extends about a hub 158 of conveyor 150. The solid bowl section 156 can also be substantially conical with the large diameter facing the support (see FIGS. 11 and 12). Bowl 152 further includes a solid first conical bowl section 160 connected in cantilever fashion from a free or downstream end of solid bowl section 156 disposed opposite the machine support 154. Conical bowl section 160 functions as a beach and tapers inwardly towards an axis 162 of conveyor 150 and bowl 152, in a downstream direction away from solid bowl section 156 and machine support 154. A second conical bowl section 164 in the form of a conical screen or basket is connected at an upstream end to a free or cantilevered end of conveyor hub 158, opposite machine support 154. Thus, basket 164 rotates at the same angular velocity as hub 158, which is different from the angular velocity of solid bowl section 156 and conical beach section 160. Conical basket 164 tapers outwardly from rotation axis 162 in a downstream direction, away from the free or cantilevered end of hub 158.

Conveyor 150 includes multiple helical blades 166 which, in the region of solid bowl section 156, are attached to radially outer edges of a plurality of axially extending vanes 168 rigid with conveyor hub 158. Conveyor blades 166 extend only part of a distance from an inner surface of solid bowl section 156 to hub 158 and are made of ribbon blade segments supported by vanes 168. The advantages and functions of vanes 168 are discussed above with reference to vanes 118.

A feed pipe 172 extends into hub 158 for delivering thereto a relatively dilute feed composition including 5–50% solids. Conveyor 150 is provided with a feed accelerator 174 mounted to hub 158 for providing the incoming feed composition with a tangential velocity substantially equal to or greater than the tangential velocity of the slurry at the radially inner surface of a clarifier pool 170. Accelerator 174 includes a distributor 176 which receives the incoming feed composition and directs it to a plurality of feed openings or passageways 178 in hub 158. Distributor 176 may be formed with a plurality of axially extending vanes (not shown) for imparting some measure of tangential velocity to the feed composition prior to the exit of the feed composition through feed openings 178. Accelerator 174 further includes a plurality of anti-Coriolis baffles 180 extending inwardly into hub 158 at respective feed openings 178. In addition, accelerator 174 may include a plurality of vanes (not shown) extending substantially radially outwardly from respective feed openings 178 and, optionally, one or more smoothening elements located between feed openings 178 and clarifier pool 170 for spreading out the feed stream from each opening 178. Again, all of these features are described in detail in U.S. Pat. Nos. 5,551,943, 5,632,714, and 5,520,605, the disclosures of which are incorporated by reference into this disclosure.

A plurality of conveyor blades or helical scrolling elements 182 are attached to an outer surface of conical bowl or beach section 160 and to an outer surface of solid bowl section 156 for scrolling cake solids along an inner surface of conical bowl section or basket 164 to an end-type cake discharge opening 184, as indicated by arrows 186. Conveyor blades or scrolling elements 182 are turned in the same sense as conveyor blades 166 inside solid bowl 152. Solid bowl section 156 and conical bowl or beach section 160, as well as blades or scrolling elements 182 welded along the outer surfaces thereof, are rotated at a speed different from rotation speed of conveyor hub 158 and basket 164 to thereby effect a continuous discharge and control of retention time of the solids in solid bowl section 156 as well as in basket 164.

Conical basket 164 effects thin cake dewatering inasmuch as the cake is spread out at a larger screen circumference toward cake discharge rim or lip 142 and 184. This benefit is enhanced by a higher G-force for dewatering as the cake is conveyed to a larger diameter.

The cantilever centrifuge of FIG. 6 is assembled in three stages or steps. First, hub 158 together with conveyor blades 166 is mounted to machine support 154 and particularly to a first drive shaft 155 which is connected to the spline shaft 155*a* of the gear box. Then, solid-bowl section 156 and conical bowl or beach section 160, together with conveyor blades or scrolling elements 182, are mounted to machine support 154 (gear housing, bearings, casing, motor and sheave) and particularly to a second drive shaft 157 thereof. Lastly, conical basket 164 is attached to the free or cantilevered end of hub 158. It is to be noted that the clearances between the conveyor blades 166 and the inner surfaces of solid bowl section 156 and conical beach section 160 and between conveyor blades or scrolling elements 182 and the inner surface of conical bowl section or basket 164 may be controlled by axial adjustment of the mounting components.

Figure 7:
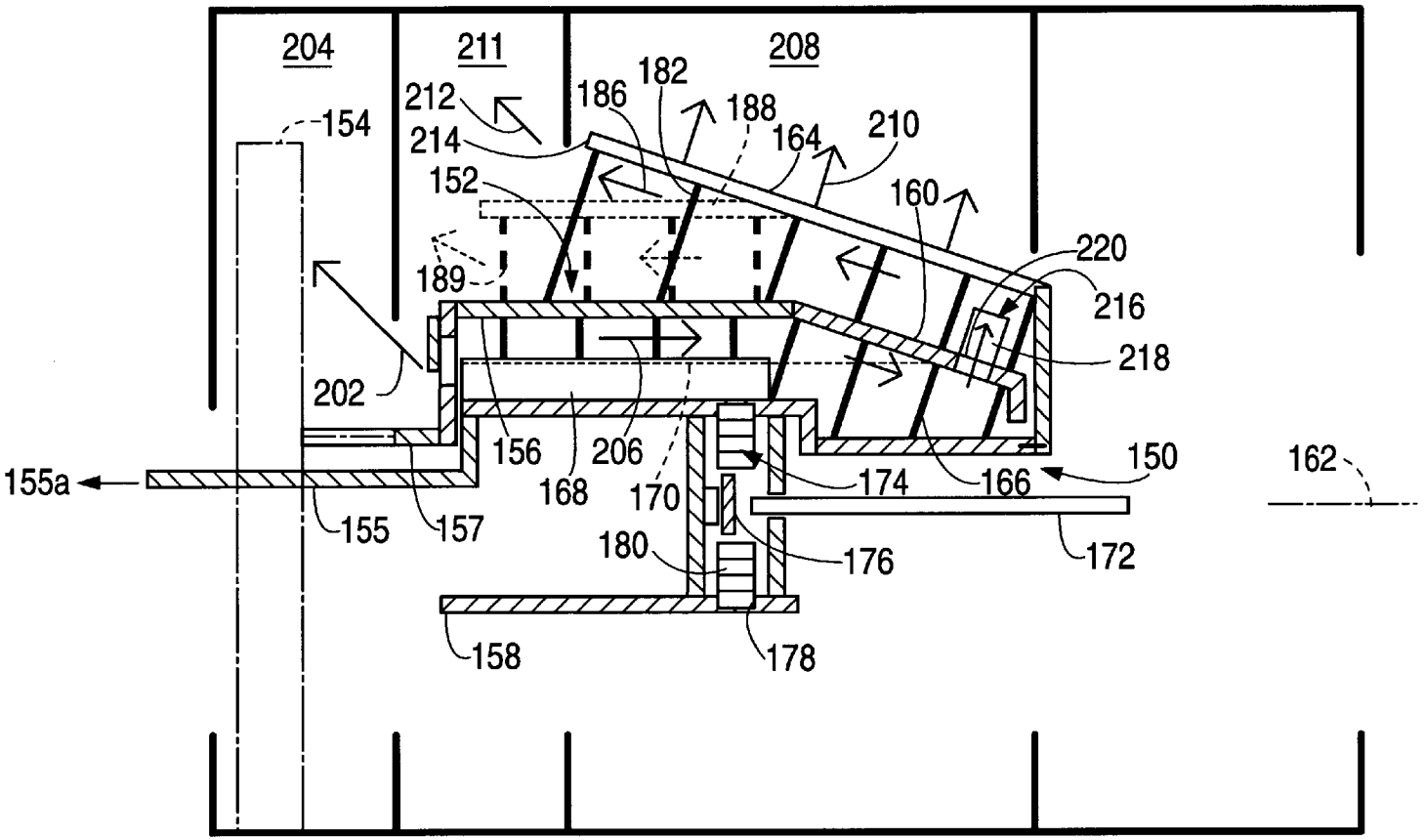
FIG. 7 is a partial longitudinal cross-sectional view of a further cantilever conical screen bowl centrifuge in accordance with the present invention.

It is to be noted that in the embodiments of FIGS. 6 and 7, conical bowl section or basket 164 surrounds at least a portion of conical bowl or beach section 160 and solid bowl section 156. Because conical bowl section or basket 164 turns back toward machine support 154, the overhung moment is reduced. Conical bowl section or basket 164 can be made longer than in cantilever centrifuges where the screen extends away from the machine support.

An additional cylindrical screen section 188 may be connected to the downstream end of conical bowl section or basket 164. In that case, a respective plurality of conveyor blades or helical scrolling elements 189 are attached to an outer surface of solid bowl section 156 for scrolling cake solids along an inner surface of cylindrical screen section 188 to a cake discharge opening (not designated), as indicated by a dashed arrow. Conveyor blades or scrolling elements 189 are also turned in the same sense as conveyor blades 166 inside solid bowl section 156. The addition of cylindrical screen extension 188 serves to increase the retention time needed for cake washing as well as dewatering.

Figure 8:
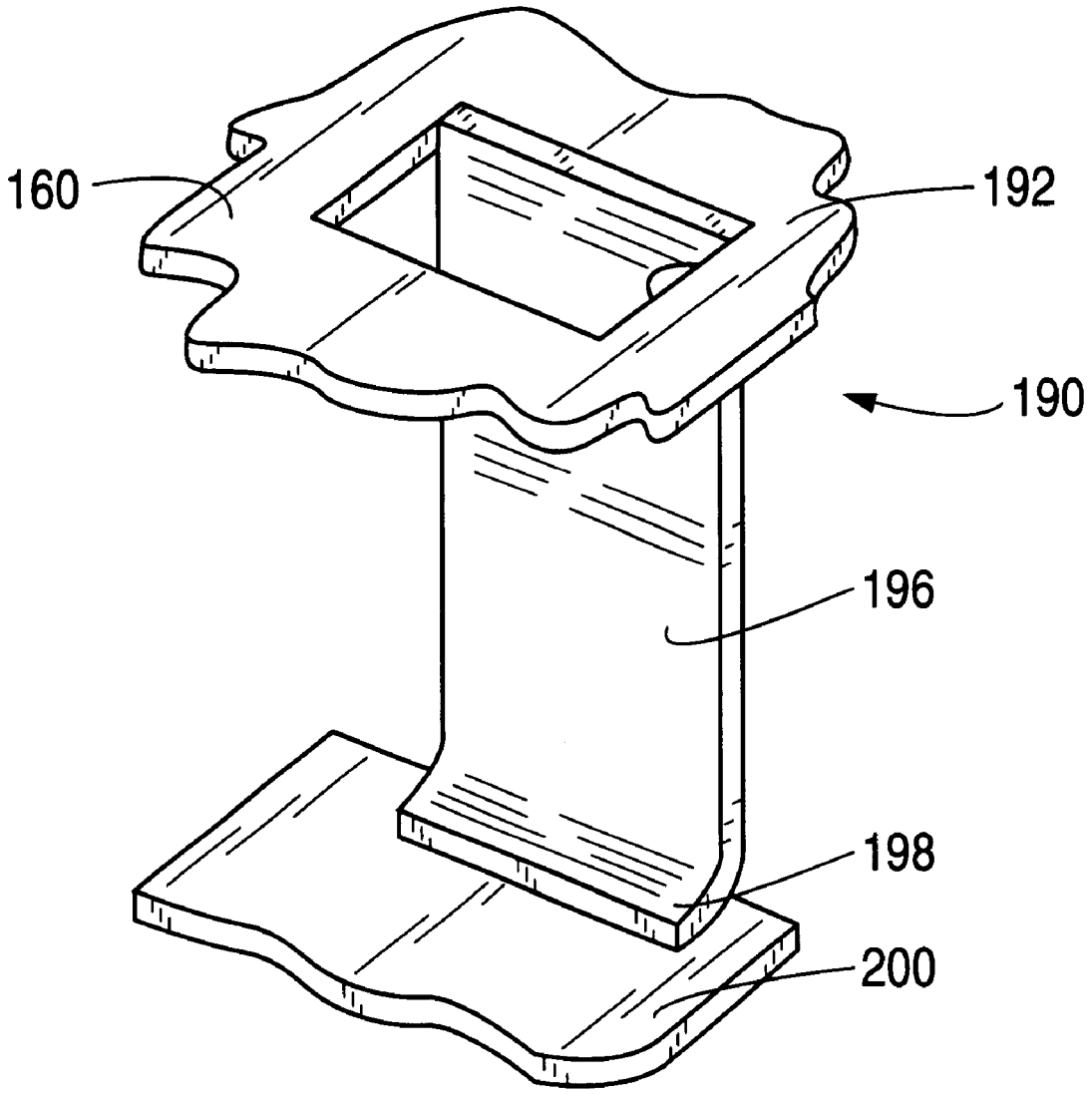
FIG. 8 is a schematic view of a feed accelerator provided in the centrifuge of FIG. 6.

The centrifuge of FIG. 6 has an additional feed accelerator 190 which is disposed at the downstream end of conical bowl section or beach 160 for tangentially accelerating a thickened feed or cake of nominally 40–60% solids moving from the downstream end of conical bowl section 160 to the upstream (small diameter) end of basket 164. Thus, feed accelerator 190 is provided at the downstream end of beach 160 at a feed opening or passageway 192 provided for guiding the thickened feed or cake from beach 160 to basket 164. As illustrated in FIG. 8, feed accelerator 190 generally includes a vane 196 (FIG. 8) extending outwardly from passageway 192 towards an inner surface of basket 164. Vane 196 is optionally provided with an outer end 198 which is curved forward in the direction of rotation for providing an additional tangential velocity component (overspeed) to, and reducing a radial velocity component of, the thickened feed or cake being delivered to the upstream end of basket 164. Feed accelerator 190 may also include a smoothening element 200 in part for spreading the thickened feed or cake out along a greater area of basket 164 and in part for reducing any concentrated stream of thickened feed or cake which impinges on basket 164. Additionally, feed accelerator 190 may include side walls (not shown) to contain the flow of heavy phase as the heavy phase is accelerated radially outwardly. The side walls together with the surface 196 forms a U-shaped channel. U.S. Pat. Nos. 5,551,943, 5,632,714, and 5,520,605, incorporated by reference herein, discuss the operation and structure of the various components of feed accelerator 190. Adapting the accelerator components of those disclosures to feed accelerator 190 is a routine matter for one skilled in the art.

During the operation of the cantilever conical screen bowl centrifuge of FIG. 6, effluent leaves the clarifier pool 170 at 202 and enters a casing compartment or chamber 204, while cake solids are conveyed along inner surfaces of solid bowl section 156 and conical beach section 160 by blades 166 of conveyor 150, as indicated by arrows 206, and subsequently along an inner surface of conical screen section or basket 164 by blades or scrolling elements 182 as indicated by arrows 186. Along conical screen section or basket 164, filtrate exits bowl 152 into a casing compartment or chamber 208, as indicated by arrows 210. Finally, cake is discharged through opening 184 into a casing compartment or chamber 211, as indicated by an arrow 212.

FIG. 7 depicts a cantilever conical screen bowl centrifuge virtually identical to that of FIG. 6 except that heavy phase passes from conical bowl section 160 to the upstream end of conical screen bowl section 164 via a side opening or passageway 220 rather than an end opening or passageway 192. In addition, the centrifuge of FIG. 7 includes a feed accelerator 216 consisting essentially of a vane 218 extending circumferentially and radially outwardly from a passageway or opening 220 in conical bowl section 160. The assembly of the centrifuge of FIG. 7 is virtually identical to the assembly of the centrifuge of FIG. 6. Reference numerals used in FIG. 7 correspond to those used for the same elements in FIG. 6.

Multiple conveyor leads (for example, double, triple or quadruple leads) or blades 116, 166, and 182 are used herein to reduce the cake height effecting dewatering via drainage in basket sections 114 and 164. This also reduces the entrainment of the sediment in clarifier pools 120 and 170 for solid bowl sections 106 and 156. All wear prone areas of conveyors 100 and 150, bowls 106 and 156 and screen/baskets 114 and 164 are protected by wear resistant materials such as tungsten carbide, silicone carbide, ceramic, hard-facing or other wear resisting coating materials.

Figure 1A:
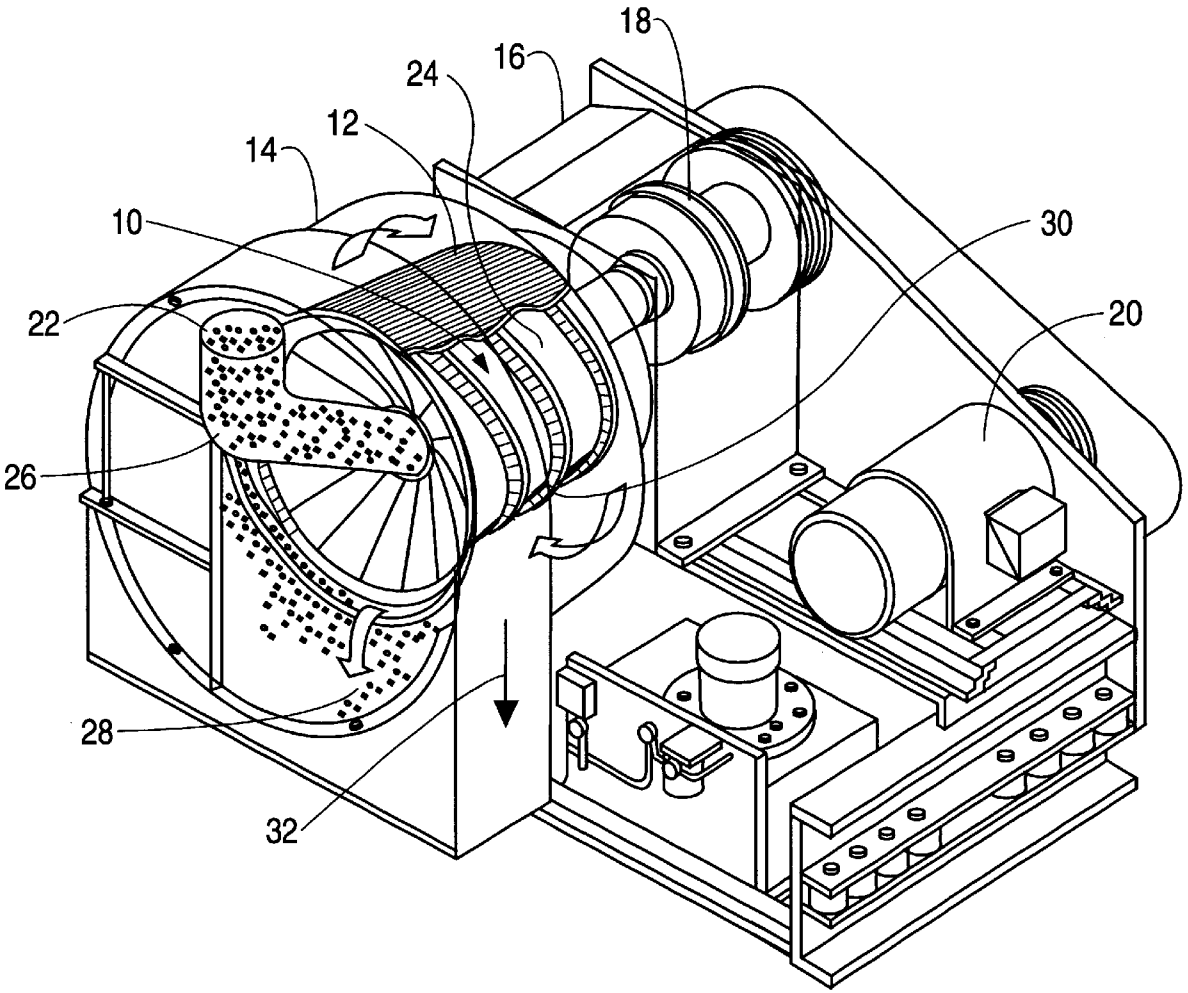
FIG. 1A PRIOR ART
FIG. 1A is a partially broken away isometric view of a circular style cantilever scroll centrifuge, in accordance with the prior art.
Figure 1B:
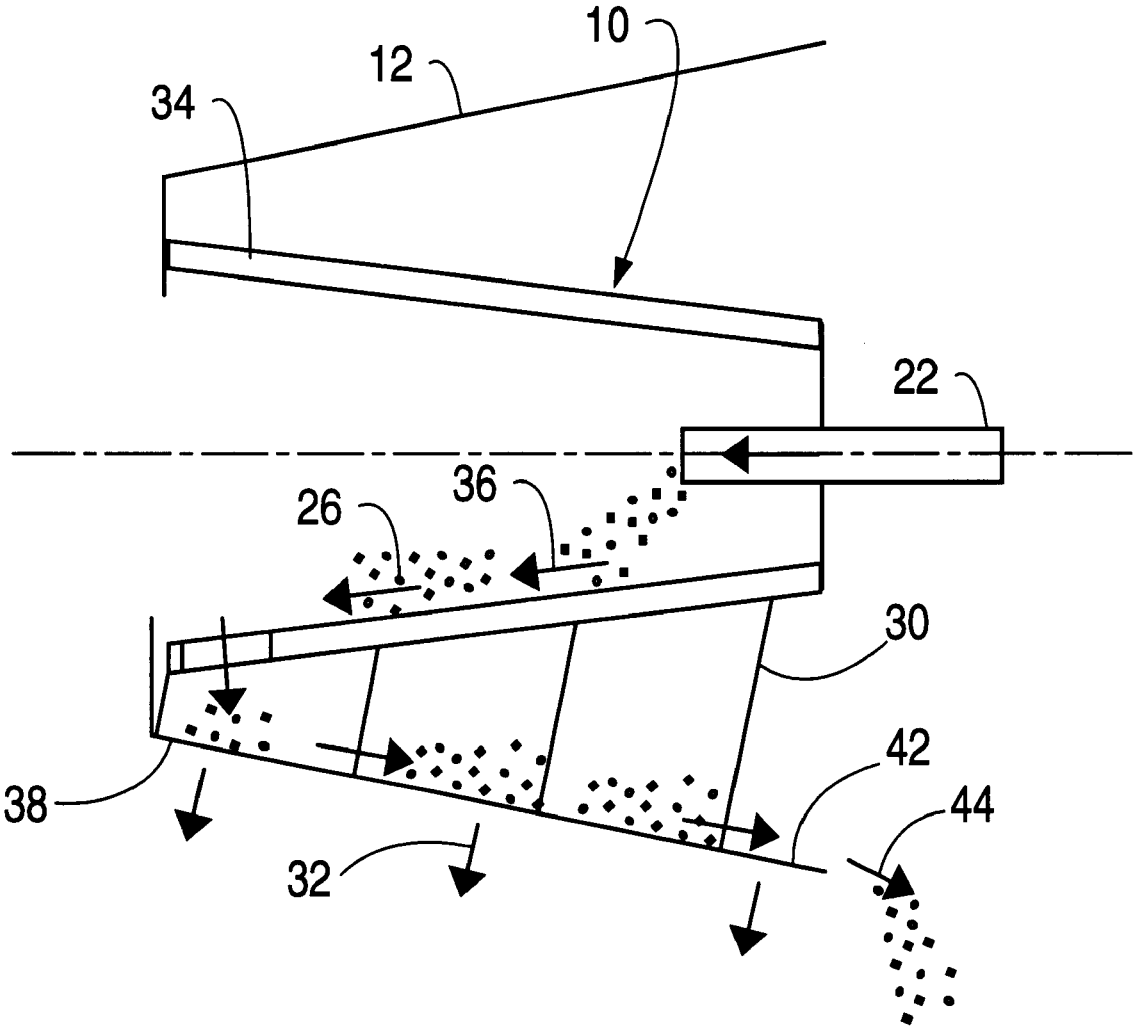
FIG. 1B PRIOR ART
FIG. 1B is a diagram of the cantilever scroll centrifuge of FIG. 1A, showing its operation.
Figure 2:
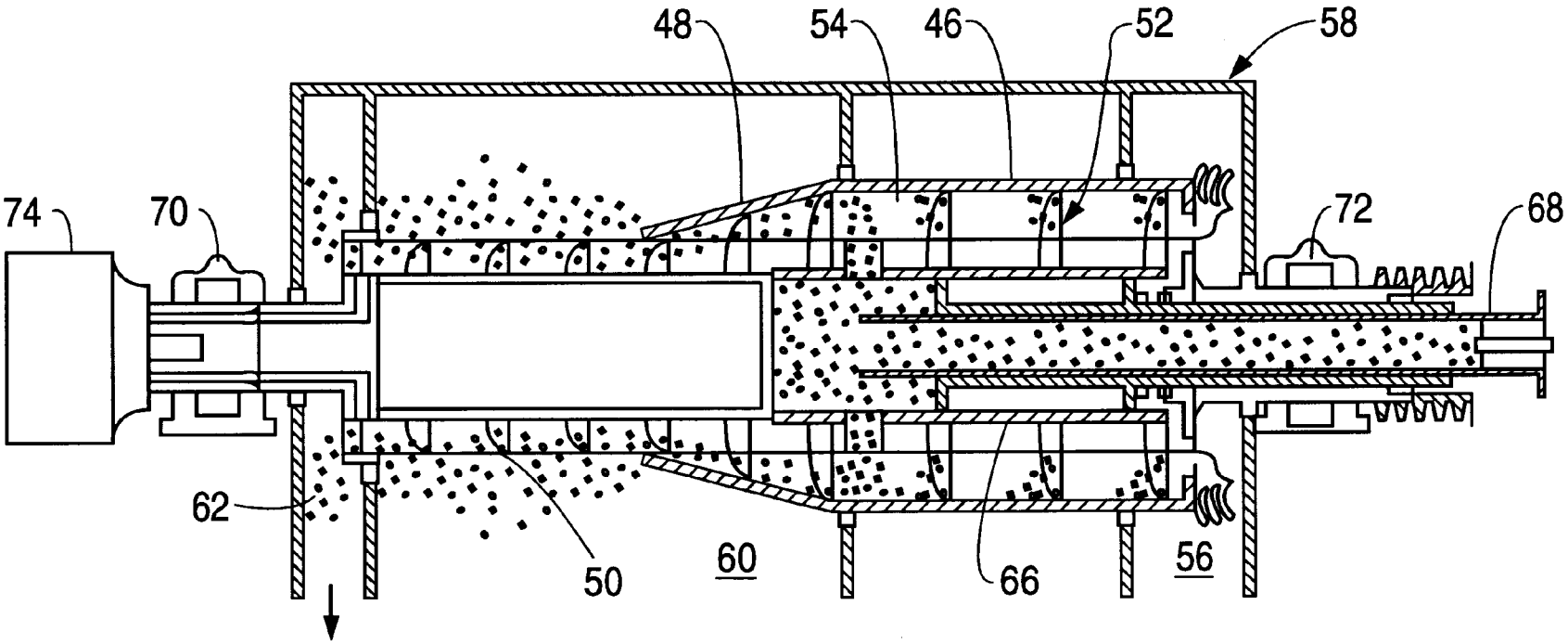
FIG. 2 PRIOR ART
FIG. 2 is a longitudinal cross-sectional view of a screen bowl centrifuge, supported at opposite ends, in accordance with the prior art.
Figure 3:
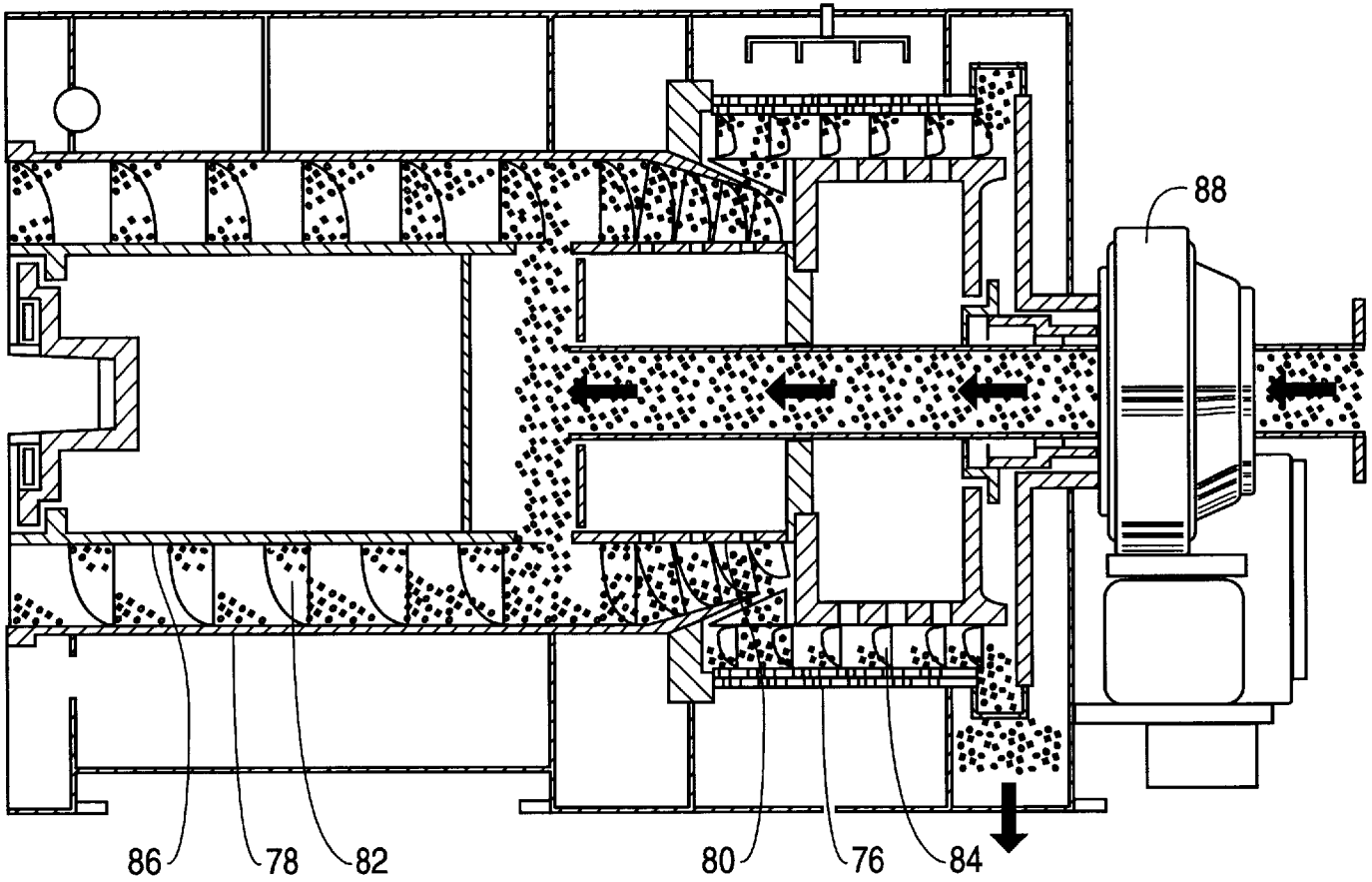
FIG. 3 PRIOR ART
FIG. 3 is a longitudinal cross-sectional view of another screen bowl centrifuge, supported at opposite ends, in accordance with the prior art.
Figure 4:
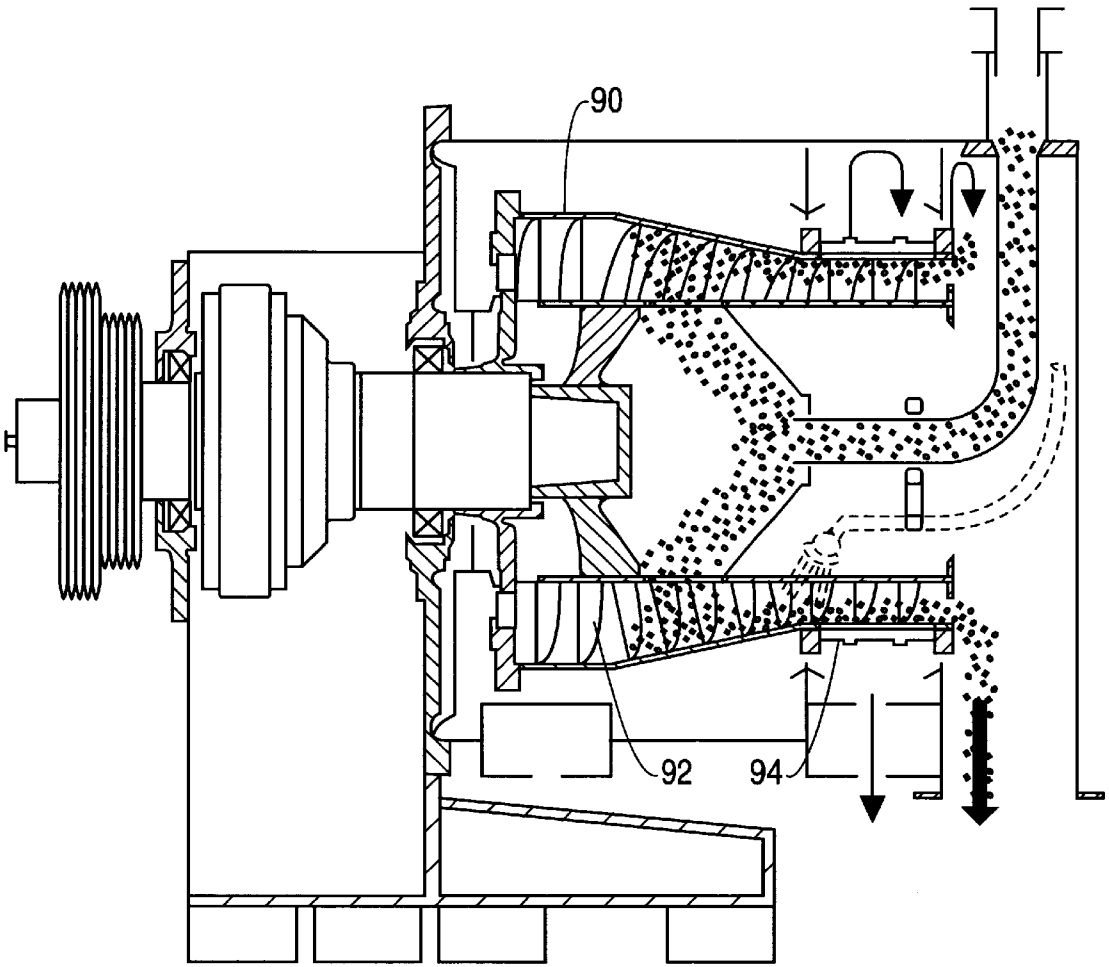
FIG. 4 PRIOR ART
FIG. 4 is a longitudinal cross-sectional view of a cantilever screen centrifuge, which is used in conjunction with ancillary pre-thickening apparatus, in accordance with the prior art.

If needed, the cake can also be washed at the small diameter or upstream ends of baskets 114 and 164. An important advantage is that the basket size can be identical to that of a regular screen-scroll without compromise. This makes it easy to retrofit an existing screen scroll centrifuge, such as shown in FIGS. 1A and 1B, to incorporate the design of FIGS. 6 and 7. Thus, the prethickener equipment of the screen scroll centrifuge can be eliminated. It is to be noted that the lengths of solid bowl sections 106 and 156 as well as baskets 114 and 164 in FIGS. 6–7 can be significantly greater than those of FIGS. 4 and 5 because the center of mass of the rotating assembly is closer to the cantilever supports 104 and 154. The centrifuge of FIGS. 6 and 7 has a further advantage that the G-field is greater at a larger diameter as compared to the prior art shown in FIG. 4 and without the wear associated with the abrupt discharge of the thickened material to a larger screen diameter as shown in FIG. 3.

Figure 9:
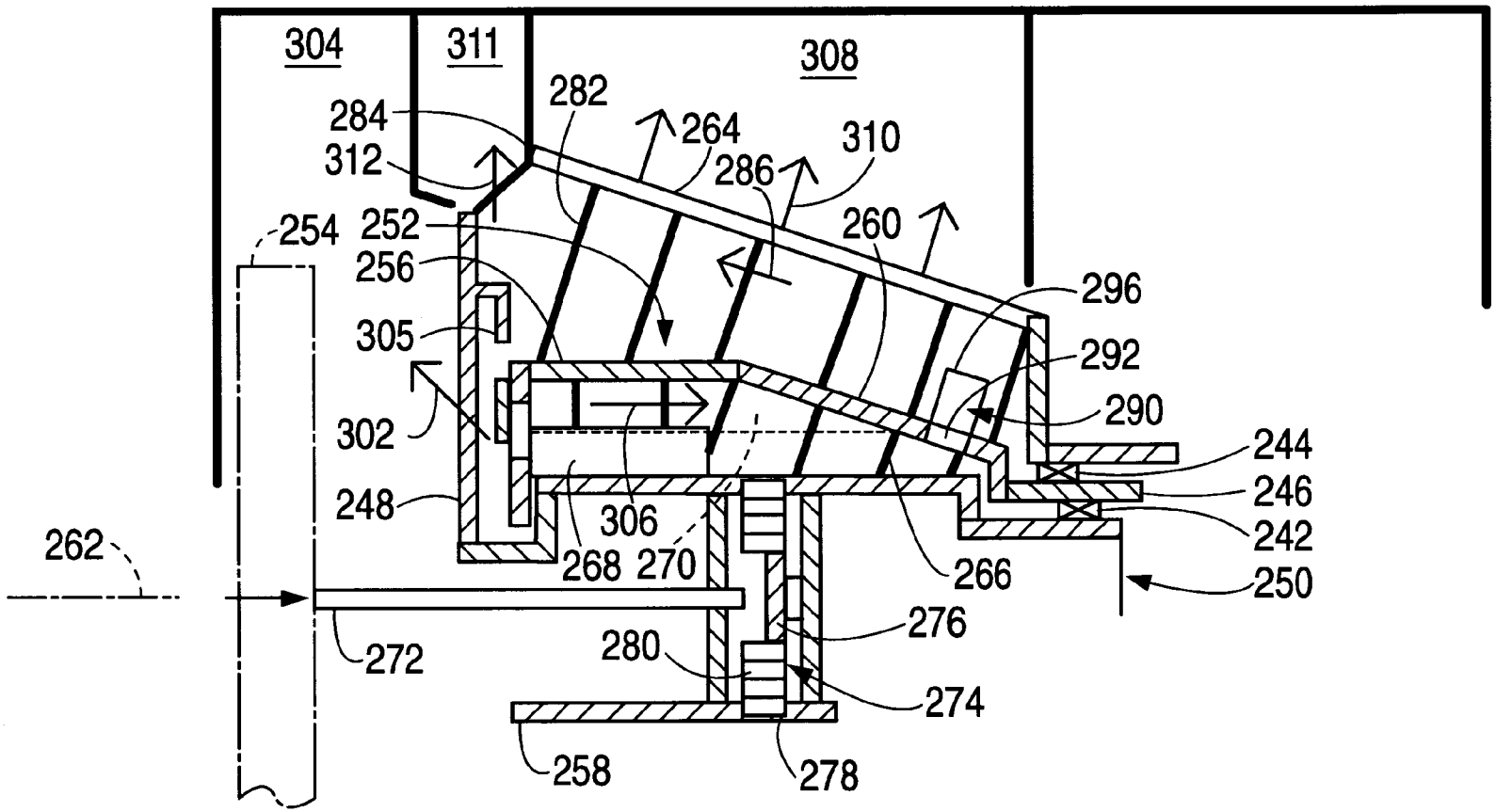
FIG. 9 is a partial longitudinal cross-sectional view of an additional cantilever conical screen bowl centrifuge in accordance with the present invention.

As depicted in FIG. 9, another cantilever conical screen bowl centrifuge comprises a scroll- or worm-type conveyor 250 and a solid bowl 252 both rotatably cantilevered from a machine support 254 which includes a gear box, bearings, motor and sheave (none illustrated). Bowl 252 includes a substantially cylindrical solid bowl section 256 which extends about a hub 258 of conveyor 250. Bowl 252 further includes a solid first conical bowl section 260 connected in cantilever fashion from a free or downstream end of cylindrical solid bowl section 256 disposed opposite the machine support 254. Conical bowl section 260 functions as a beach and tapers inwardly towards an axis 262 of conveyor 250 and bowl 252, in a downstream direction away from solid bowl section 256 and machine support 254.

In the centrifuge of FIG. 9, a second conical bowl section 264 in the form of a conical screen or basket is drivingly secured at a downstream end to conveyor hub 258 via a spider support 248. Screen or basket 264 is rotatably mounted at an upstream end to a free or cantilevered end of conveyor hub 258 via a cantilevered extension 246 of conical bowl section 260 and a pair of bearings 244 and 242. Thus, basket 264 rotates at the same angular velocity as hub 258, which is different from the angular velocity of solid bowl section 256 and conical beach section 260. Conical basket 264 tapers outwardly from rotation axis 262 in a downstream direction, away from the free or cantilevered end of hub 258 and toward machine support 254.

Conveyor 250 includes multiple helical blades 266 which, in the region of solid bowl section 256, are attached to radially outer edges of a plurality of axially extending vanes 268 rigidly attached to conveyor hub 258. Conveyor blades 266 extend only part of a distance from an inner surface of solid bowl section 256 to hub 258 and are made of ribbon blade segments supported by vanes 268. The advantages and functions of vanes 268 are discussed above with reference to vanes 118.

A feed pipe 272 extends into hub 258 for delivering thereto a relatively dilute feed composition including 5–50% solids. Conveyor 250 is provided with a feed accelerator 274 mounted to hub 258 for providing the incoming feed composition with a tangential velocity substantially equal to or greater than the tangential velocity of the slurry at the radially inner surface of a clarifier pool 270. Accelerator 274 includes a distributor 276 which receives the incoming feed composition and directs it to a plurality of feed openings or passageways 278 in hub 258. Distributor 276 may be formed with a plurality of axially extending vanes (not shown) for imparting some measure of tangential velocity to the feed composition prior to the exit of the feed composition through feed openings 278. Accelerator 274 further includes a plurality of anti-Coriolis baffles 280 extending inwardly into hub 258 at respective feed openings 278. In addition, accelerator 274 may include a plurality of vanes (not shown) extending substantially radially outwardly from respective feed openings 278 and, optionally, one or more smoothening elements located between feed openings 278 and clarifier pool 270 for spreading out the feed stream from each opening 278. To reiterate, all of these features are described in detail in U.S. Pat. Nos. 5,551,943, 5,632,714, and 5,520,605, incorporated by reference herein.

A plurality of conveyor blades or helical scrolling elements 282 are attached to an outer surface of conical bowl or beach section 260 and to an outer surface of solid bowl section 256 for scrolling cake solids along an inner surface of conical bowl section or basket 264 to a cake discharge opening 284, as indicated by an arrow 286. Conveyor blades or scrolling elements 282 are turned in the same sense as conveyor blades 266 inside solid bowl 252. Solid bowl section 256 and conical bowl or beach section 260, as well as blades or scrolling elements 282 welded along the outer surfaces thereof, are rotated at a speed different from rotation speed of conveyor hub 258 and basket 264 to thereby effect a continuous discharge and control of retention time of the solids in solid bowl section 256 as well as in basket 264.

The centrifuge of FIG. 9 has an additional feed accelerator 290 which is disposed at the downstream end of conical bowl section or beach 260 for tangentially accelerating a thickened feed or cake of nominally 4–60% solids moving from the downstream end of conical bowl section 260 to the upstream (small diameter) end of basket 264. Thus, feed accelerator 290 is provided at the downstream end of beach 260 at a feed opening or passageway 292 provided for guiding the thickened feed or cake from beach 260 to basket 264. Feed accelerator 290 generally includes a vane 296 extending outwardly from passageway 292 towards an inner surface of basket 264. That vane is optionally provided with an outer end (198 in FIG. 8) which is curved forward in the direction of rotation for providing an additional tangential velocity component (overspeed) to, and reducing a radial velocity component of, the thickened feed or cake being delivered to the upstream end of basket 264. Feed accelerator 290 may additionally include a smoothening element (200 in FIG. 8) for spreading the thickened feed or cake out along a greater area of basket 264 and reducing any concentrated stream of thickened feed or cake impinging on basket 264 or, alternatively, the basket location where the feed is introduced can serve as a smoothener for the feed.

During the operation of the cantilever conical screen bowl centrifuge of FIG. 9, effluent leaves the clarifier pool 270 at 302 and enters a casing compartment or chamber 304. The effluent is blocked from entering basket 264 by a catcher or shield 305. Cake solids are conveyed along inner surfaces of solid bowl section 256 and conical beach section 260 by blades 266 of conveyor 250, as indicated by arrows 306, and subsequently along an inner surface of conical screen section or basket 264 by blades or scrolling elements 282 as indicated by arrows 286. Along conical screen section or basket 264, filtrate exits bowl 252 into a casing compartment or chamber 308, as indicated by arrows 310. Finally, cake is discharged through opening 284 into a casing compartment or chamber 311, as indicated by a narrow 312.

Figure 10:
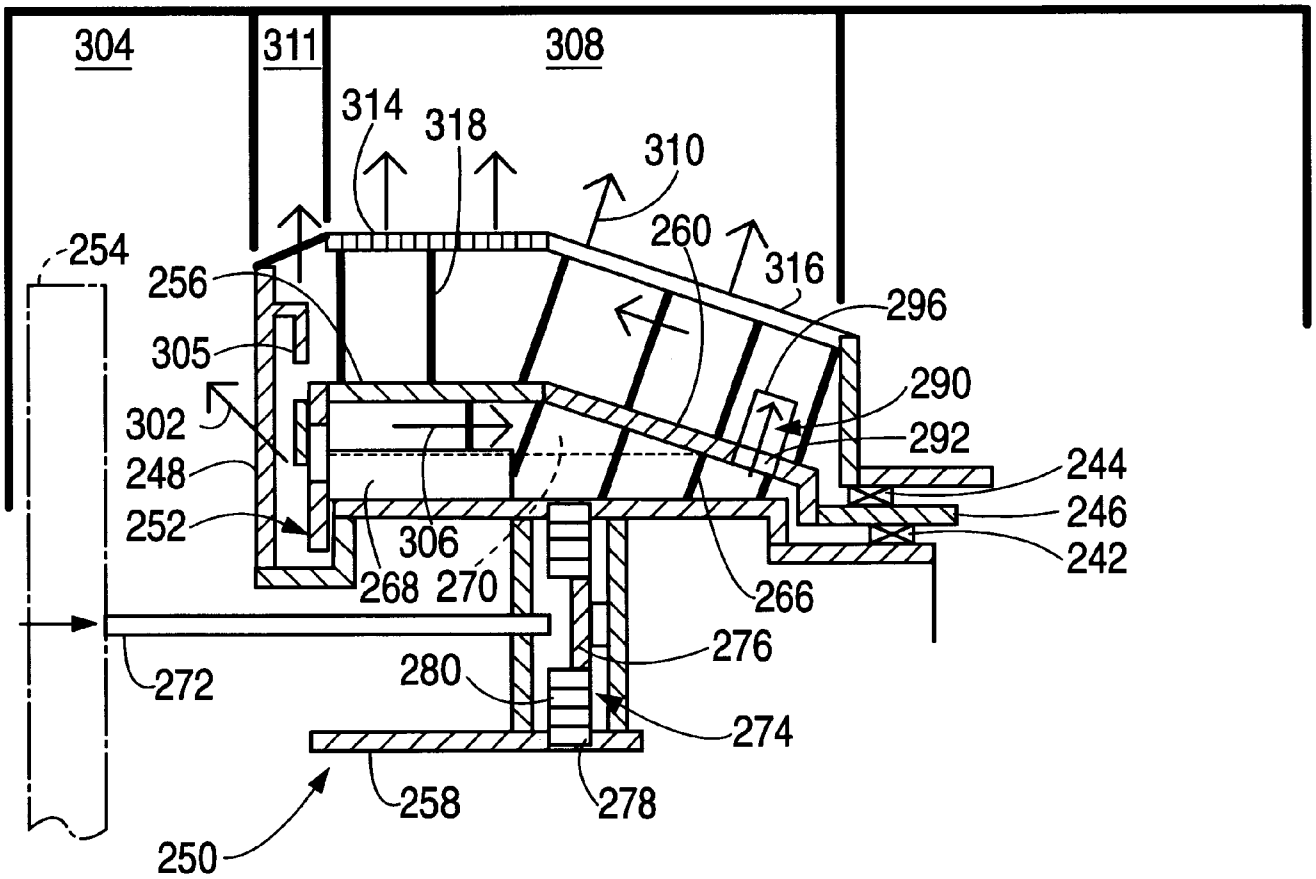
FIG. 10 is a partial longitudinal cross-sectional view of an alternative cantilever conical screen bowl centrifuge in accordance with the present invention.

FIG. 10 depicts a cantilever conical screen bowl centrifuge virtually identical to that of FIG. 9 except that conical screen bowl section 264 has been replaced by a conical screen bowl section 314 and a cylindrical screen bowl section 316. Conical screen bowl section 314 is substantially co-extensive with conical bowl section 264 in an axial direction, while cylindrical screen bowl section 316 is nearly coextensive with cylindrical bowl section 256. Conveyor blades 282 are modified at 318 to extend to an inner surface (not labeled) of cylindrical screen bowl section 316.

FIG. 11 also depicts a cantilever conical screen bowl centrifuge virtually identical to that of FIG. 9 except that solid bowl sections 256 and 260 have been replaced by a single solid conical bowl section 320. Solid bowl section 320 and screen bowl section 264 are substantially co-extensive with one another in an axial direction. Conveyor blades 266 are modified at 322 so that the outer ends or edges of the conveyor blades extend to an inner surface (not labeled) of solid bowl section 320. Likewise, conveyor blades 282 are shortened at 323.

Figure 12:
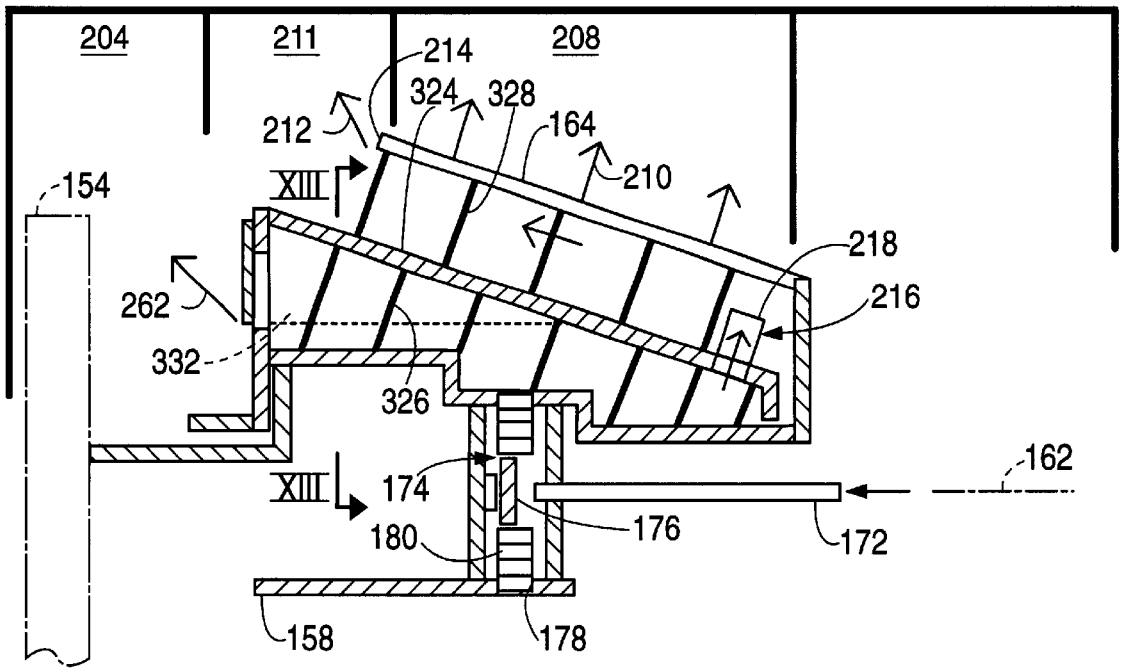
FIG. 12 is a partial longitudinal cross-sectional view of yet another cantilever conical screen bowl centrifuge in accordance with the present invention.
Figure 13:
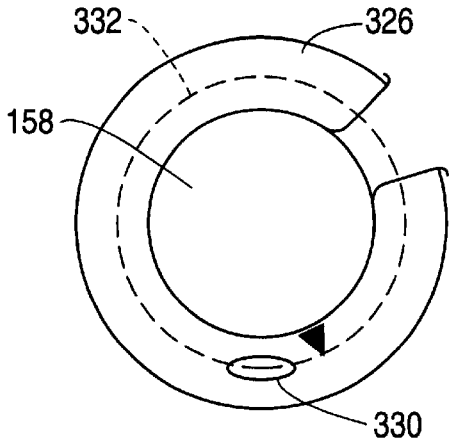
FIG. 13 is a schematic partial transverse cross-sectional taken along line XII—XIII in FIG. 12.

FIG. 12 illustrates a modification of the centrifuge of FIG. 7 wherein cylindrical solid bowl section 156 and conical bowl section 160 are replaced by a single solid conical bowl section 324. Conical basket 164 is fixed at an upstream end to a cantilevered end of conveyor hub 158 via a flange 326. Thus, basket 164 rotates at the same angular velocity as hub 158. Bowl section 324 is mounted for rotation about axis 162 at an angular speed slightly different from that of hub 158. Conveyor blades 166 and 182 (FIG. 7) are replaced by helical conveyor blades 326 and 328 conforming to the modified bowl design. Conveyor blades 328 extend the entire radial distance between conveyor hub 158 and the inner surface (not designated) of solid bowl section 324. As shown in FIG. 13, each wrap of conveyor blades 326 is provided with four to six circumferentially equi-spaced elliptical openings 330 to permit effluent to flow axially near the surface of a clarifier pool 332. This avoids a flow of high velocity effluent liquid through the helical channels of the conveyor blades 326, which would entrain the settled solids in the cake. Dilute feed after properly accelerated by feed accelerator 174 discharges into clarifier pool 170 for separation.

An advantage of the embodiment of FIG. 12 is that clarifier pool 332 has an increased volume relative to pool 170, thus facilitating sedimentation. The design of FIG. 12 is relatively compact and space efficient. The height and mass of the outer conveyor blades 328 are reduced relative to the design of FIG. 7, thus reducing the overall conveyor mass.

Although the invention has been described in terms of particular embodiments and applications, one of ordinary skill in the art, in light of this teaching, can generate additional embodiments and modifications without departing from the spirit of or exceeding the scope of the claimed invention. For example, it is to be understood that the conical solid bowl sections and the conical screen bowl sections disclosed herein may each include multiple conical bowl sections extending at different angles relative to the axis of the machine. Thus, cylindrical screen section 188 in FIG. 7 may be alternatively formed as a conical section having a cone angle different from that of conical screen bowl section 164. Similarly, cylindrical screen bowl section 314 in FIG. 10 may be replaced by another conical screen bowl section having an angle of inclination different from that of conical screen bowl section 316. Accordingly, it is to be understood that the drawings and descriptions herein are proffered by way of example to facilitate comprehension of the invention and should not be construed to limit the scope thereof.

What is claimed is:

1. A centrifuge comprising:

a hub;

a first bowl section extending about said hub, said first bowl section having a first diameter at a downstream end of a heavy phase transport path along said first bowl section;

a second bowl section having an input end at said downstream end of said first bowl section, said input end having a second diameter larger than said first diameter, said input end being disposed radially outwardly of said first bowl section at said downstream end; and a feed accelerator disposed at said downstream end for tangentially accelerating a thickened feed or cake between said downstream end of said first conical bowl section and said input end of said second bowl section.

2. The centrifuge defined in claim 1 wherein said hub is provided with a first conveyor blade for conveying heavy phase material along said first bowl section towards said downstream end, said first bowl section being provided along an outer surface with a second conveyor blade for conveying heavy phase material along an inner surface of said second bowl section from said input end towards a cake discharge port.

3. The centrifuge defined in claim 2 wherein said second bowl section includes a screen bowl portion.

4. The centrifuge defined in claim 3 wherein said screen bowl portion is conical.

5. The centrifuge defined in claim 4, further comprising a machine support, said hub, said first bowl section and said second bowl section all being cantilevered from said machine support.

6. The centrifuge defined in claim 1 wherein said first bowl section is provided at said downstream end with a passageway, said feed accelerator including a vane extending outwardly from said passageway towards an inner surface of said second bowl section.

7. The centrifuge defined in claim 6 wherein said vane is provided with an outer end which is curved forward in a direction of rotation at least in part for providing an additional tangential velocity component to said thickened feed or cake.

8. The centrifuge defined in claim 1 wherein said second bowl section has a conically shaped upstream portion and a cylindrically shaped downstream portion.

9. The centrifuge defined in claim 8 wherein said conically shaped upstream portion is a conical basket section, said cylindrically shaped downstream portion being a screen bowl.

10. The centrifuge defined in claim 1 wherein said feed accelerator includes a smoothening element at least in part for spreading the thickened feed or cake out along a greater area of said second bowl section.

11. The centrifuge defined in claim 1, further comprising a conveyor for scrolling thickened feed or cake solids along an inner surface of said first bowl section towards said downstream end, said conveyor having a hub, also comprising a feed accelerator disposed in said hub for tangentially accelerating a feed slurry from said hub prior to delivering said feed slurry to a slurry pool in said first bowl section.

12. The centrifuge defined in claim 1, further comprising a conveyor for scrolling thickened feed or cake solids along an inner surface of said first bowl section towards said downstream end, said conveyor having a hub and plurality of generally axial vanes extending from said hub along a substantial portion of said first bowl section, said conveyor having a conveyor blade attached to radially outer edges of said vanes so that said blade extends only part of a distance from an inner surface of said solid bowl to said hub.

13. The centrifuge defined in claim 1 wherein said feed accelerator is disposed radially between said first bowl section and said second bowl section.

14. A method for separating a solid phase from a liquid phase of a slurry, comprising:

feeding a slurry from a conveyor hub outwardly to a clarifier pool in a bowl of a centrifuge;

scrolling thickened feed or cake solids from said clarifier pool along a first bowl section of said centrifuge to a passageway at a downstream end of said first bowl section;

tangentially accelerating a thickened feed or cake upon an exiting thereof from said first bowl section through said passageway and prior to a deposition of the thickened feed or cake on a second bowl section of said centrifuge, at said passageway said second bowl section having a greater diameter than said first bowl section; and scrolling, along said second bowl section to a cake discharge, the thickened feed or cake deposited on said second bowl section.

15. The method defined in claim 14 wherein the tangential accelerating of the cake solids includes engaging the cake solids with a vane extending outwardly from said passageway towards an inner surface of said second bowl section.

16. The method defined in claim 15 wherein said vane is provided with an outer end which is curved forward in a direction of rotation, further including providing an additional tangential velocity component to said thickened feed or cake.

17. The method defined in claim 14 further comprising spreading the thickened feed or cake out along an area of said second bowl section.

18. The method defined in claim 17 wherein the spreading of the thickened feed or cake includes engaging the thickened feed or cake with a smoothening element.

19. The method defined in claim 14, further comprising tangentially accelerating a feed slurry from a centrifuge hub prior to delivering said feed slurry to said clarifier pool in said first bowl section.

20. The method defined in claim 14 wherein said second bowl section is a basket including a filter screen, further comprising centrifugally draining filtrate from cake solids on said second bowl section through said filter screen.

21. The method defined in claim 20, further comprising washing impurities from cake solids on said second bowl section through said filter screen.

22. A cantilever conical screen bowl centrifuge comprising:

a machine support;

a scroll- or worm-type conveyor rotatably cantilevered from said machine support, said conveyor having a hub; and a bowl rotatably cantilevered from said machine support, said bowl including a solid first conical bowl section rotatably cantilevered from said machine support and extending about said hub, said bowl also including a second conical bowl section connected in cantilever fashion from a free or downstream end of said first conical bowl section opposite said machine support, said second conical bowl section extending away from said machine support.

23. The centrifuge defined in claim 22 wherein said first conical bowl section tapers inwardly towards an axis of said conveyor and said bowl, in a downstream direction away from said machine support.

24. The centrifuge defined in claim 23 wherein said second conical bowl section is a conical screen or basket.

25. The centrifuge defined in claim 23 wherein said second conical basket tapers outwardly from said axis in a direction away from the free or downstream end of said first conical bowl section.

26. The centrifuge defined in claim 22 wherein said bowl further includes a cylindrical solid bowl section cantilevered from said machine support and extending about said hub, said first conical solid bowl section being mounted indirectly to said machine support via said cylindrical solid bowl section, said first conical bowl section being connected in cantilever fashion from a free or downstream end of said cylindrical solid bowl section opposite said machine support.

* * * * *